United States Patent [19]

Ishii et al.

[11] Patent Number: 4,989,301

[45] Date of Patent: Feb. 5, 1991

[54] DRAWING DEVICE

[75] Inventors: Tomihisa Ishii; Satoshi Horibe; Tadashi Fujii, all of Gifu; Tetsuji Ohashi, Ichinomiya, all of Japan

[73] Assignee: Gifu Prefecture, Gifu, Japan

[21] Appl. No.: 418,864

[22] Filed: Oct. 10, 1989

[51] Int. Cl.[5] ..... D03J 1/14

[52] U.S. Cl. ..... 28/206; 28/203 R; 28/204

[58] Field of Search ..... 28/203, 204, 206

[56] References Cited

U.S. PATENT DOCUMENTS 3,681,825 8/1972 Meierhofer ..... 28/206
3,867,745 2/1975 Crandall et al. ..... 28/204

FOREIGN PATENT DOCUMENTS 224841 11/1985 Japan ..... 28/204
1352332 5/1974 United Kingdom ..... 28/204

*Primary Examiner*—Werner H. Schroeder
*Assistant Examiner*—Bradley Kurtz De Sandro
*Attorney, Agent, or Firm*—Oblon, Spivak, McClelland, Maier & Neustadt

[57] ABSTRACT

The drawing device inserts a warp into a heald hole of a heald and between reed dents of a reed. The device comprises an air guide including an air passage having an entrance and an exit, an air stream generating mechanism operationally connected with the air passage for generating an air stream running from the entrance toward the exit in the air passage, a heald feeding and moving mechanism for feeding one heald just in front of the entrance of the air passage and for arranging the heald so that the heald hold of the heald may be opposite to the entrance, and a warp feeding mechanism for feeding and arranging a warp just in front of the heald hole of the heald arranged just in front of the entrance of the air passage.

16 Claims, 16 Drawing Sheets

DRAWING DEVICE

FIELD OF THE INVENTION

The present invention relates to a drawing device for passing a warp through a heald and a reed.

DESCRIPTION OF THE RELATED ART

As a warp preparing step in a weaving operation, there is an operation for passing a warp through a heald hole of a heald and between reed dents of a reed. Passing the warp through the heald hole of the heald and passing it between reed dents of the reed are operations in series, but these steps are usually done by different individual devices with low work efficiency. There is proposed a device in which these steps are successively done, but there are problems that the device becomes complicated and enlarged and that a heald and a reed are easy to be scratched or flawed in the passing operation.

SUMMARY OF THE INVENTION

An object of the present invention is to provide a drawing device wherein efficiency of the operation is improved by having a single device pass a warp both through a heald and between reed dents, cutoffs of the warp are eliminated by simplifying a conveyance of the warp, and simplification and size-reduction of the device can be achieved.

Another object of the present invention is to provide a drawing device wherein a warp can be easily and surely passed through a heald and a reed.

In order to achieve the above objects, a drawing device of the present invention comprises an air guide including an air passage having an entrance and an exit, air stream generating means being operationally connected with said air passage for generating an air stream which goes from said entrance to said exit in said air passage, and oppositely arranging means for arranging said entrance of said air passage opposite to a heald hole of a heald and for arranging said exit opposite to an interval between reed dents of a reed.

Other objectives of the present invention will become apparent with an understanding of the embodiments discussed later, and the appended claims. Further many advantages not mentioned in this specification will become obvious to one skilled in the art upon application of the present invention.

DETAILED DESCRIPTION OF THE PREFERRED EMBODIMENTS (A first embodiment)

A first embodiment of the present invention is described hereinafter referring to FIGS. 1 to 13.

A driving shaft 1 is operationally connected with a not shown driving motor. Three supporting discs 2, 3, and 4 as heald moving means having the same diameter are fixed to the driving shaft 1 in parallel vertically. Six holding concaves 2*a*, 3*a*, and 4*a* as heald holding means are arranged in intervals of 60° on a peripheral surface of each supporting disc 2, 3, and 4 and magnets 5, 6 and 7 also as heald holding means are embedded in a bottom surface of each holding concave 2*a*, 3*a*, and 4*a*. The holding concaves 2*a*, 3*a*, and 4*a* on the supporting discs 2, 3, and 4 are so arranged that they totally overlap each other in the vertical direction, and the holding concaves 2*a*, 3*a* and 4*a* go around on circumferences of a same diameter with rotation of the driving shaft 1.

Figure 6:
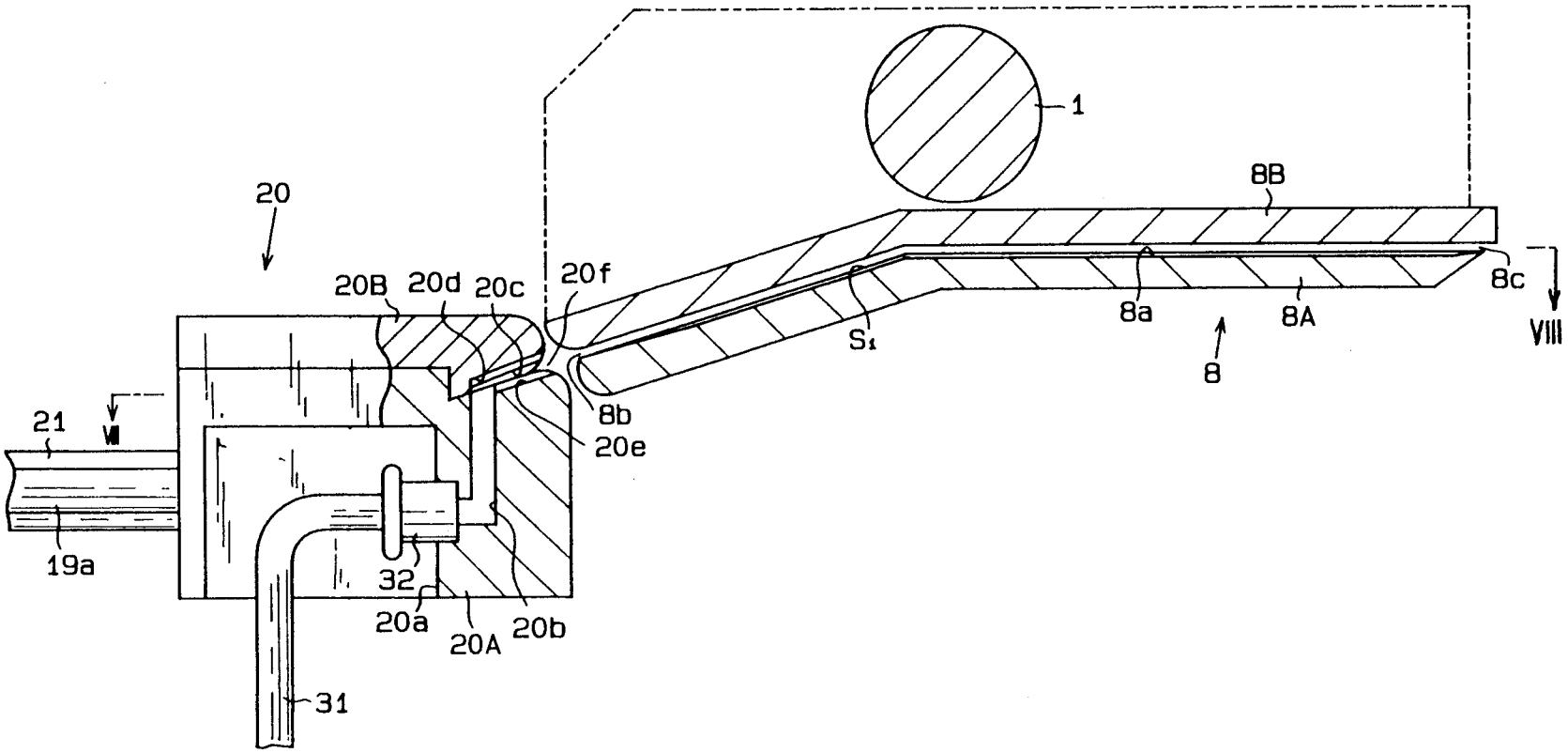
FIG. 6 is a partially broken main portion plan view showing the same state.

An air guide 8 is fixed between the supporting disc 2 of higher stage and the supporting disc 3 of middle stage. and the driving shaft 1 is passed through the air guide 8 and is rotatable relative to the air guide 8. The air guide 8 is formed by joining a pair of guiding segments 8A and 8B. A warp discharging slit S1 extending from an entrance 8*b* to an exit 8*c* communicates with a lower end of an air passage 8*a* formed to be a groove on an inner surface of the guiding segment 8A as shown in FIGS. 6 to 8, and FIG. 10. A width of the slit S1 is narrower than the air passage 8*a*, and the warp discharging slit S1 becomes a part of the air passage 8*a* at the entrance 8*b* side. Rear halves, at the exit 8*c* side, of slit forming walls 9 and 10 which define the warp discharging slit S1 extend downward much further than their front halves at the entrance 8*b* side. The air passage 8*a* and the warp discharging slit S1 are bent in the middle between the front and the rear as shown in FIG. 6.

Around this bent portion, an upper rim of the air passage 8*a* is divided into a going up slant rim 8*a*1 at the entrance 8*b* side and a horizontal rim 8*a*2 at the exit 8*c* side. At the horizontal rim 8*a*2 are provided a pair of air releasing holes 8*d* opening upward, and between both the air releasing holes 8*d* at the horizontal rim 8*a*2 is provided a warp discharging spouting hole 8*e*. A spouting direction of the warp discharging spouting hole 8*e* is preset downward and toward the exit 8*c* side, and the warp discharging spouting hole 8*e* is connected with an air supplying pipe 11 via an air supplying passage 8*f* and a pipe coupling 30 at the guiding segment 8B side.

A reed 12 is provided just in front of the exit 8c of the air guide 8 so that the reed 12 can be moved in the direction crossing the direction of the exit 8c. The reed 12 can be intermittently moved, at each motion, in a distance corresponding with an interval 12a of reed dents in the direction of an arrow P in FIG. 1 by not shown driving means, and the intervals 12a between the reed dents are successively moved to and disposed at a position opposite to the exit 8c of the air guide 8.

At the right side of the uppermost supporting disk 2, a plurality of supplying rods 13 are supported along the moving direction of the reed 12 by supporting member 14 so that the supporting rods 13 may be arranged parallel to one another in the direction crossing the moving direction of the reed 12, and a plurality of healds 15 are hooked and suspended by each supplying rod 13. A guiding member 16 extending in the vertical direction is provided right to the driving shaft and adjacent to a peripheral surface of each supporting disc 2, 3, and 4. At an opposite position of this guiding member 16 is provided an air cylinder 17 extending in the direction along the length of the supplying rods 13, and a contact member 17b is fixed to a tip of a driving rod 17a thereof. The supporting member 14 can be moved in the direction crossing the length of the supplying rods 13 by a not shown driving apparatus, and one of the supplying rods 13 supporting the healds 15 is arranged at a position opposite to the guiding member 16. Heald feeding means is composed of the supporting member 14, the air cylinder 17, and the contact member 17b.

The contact member 17b is pressed on the heald of the supplying rod 13 arranged at this opposite position with projection of the driving rod 17a of the air cylinder 17. The healds 15 are thus inserted into a guiding portion 16a of the guiding member 16, and the front heald 15 is pressed on the peripheral surface of each supporting disc 2, 3, and 4. The holding concaves 2a, 3a, and 4a of the supporting discs 2, 3, and 4 successively come to an opposite position XI to the guiding portion 16a of the guiding member 16 as the supporting discs 2, 3, and 4 are rotated, and the front heald 15 pressed on the peripheral surface of each supporting discs 2, and 4 with projecting operation of the air cylinder 17 is inserted into the holding concaves 2a, 3a, and 4a arranged at the position XI as the supporting discs 2, 3, and 4 are rotated. The heald 15 inserted into the holding concaves 2a, 3a, and 4a is attached by the magnets 5, 6, and 7 at bottoms of the holding concaves 2a, 3a, and 4a , and the single heald 15 is attached and held standing upright over the supporting discs 2, 3, and 4. Depth of each holding concave 2a, 3a, and 4a is preset corresponding approximately with thickness of the heald 15.

Figure 3:
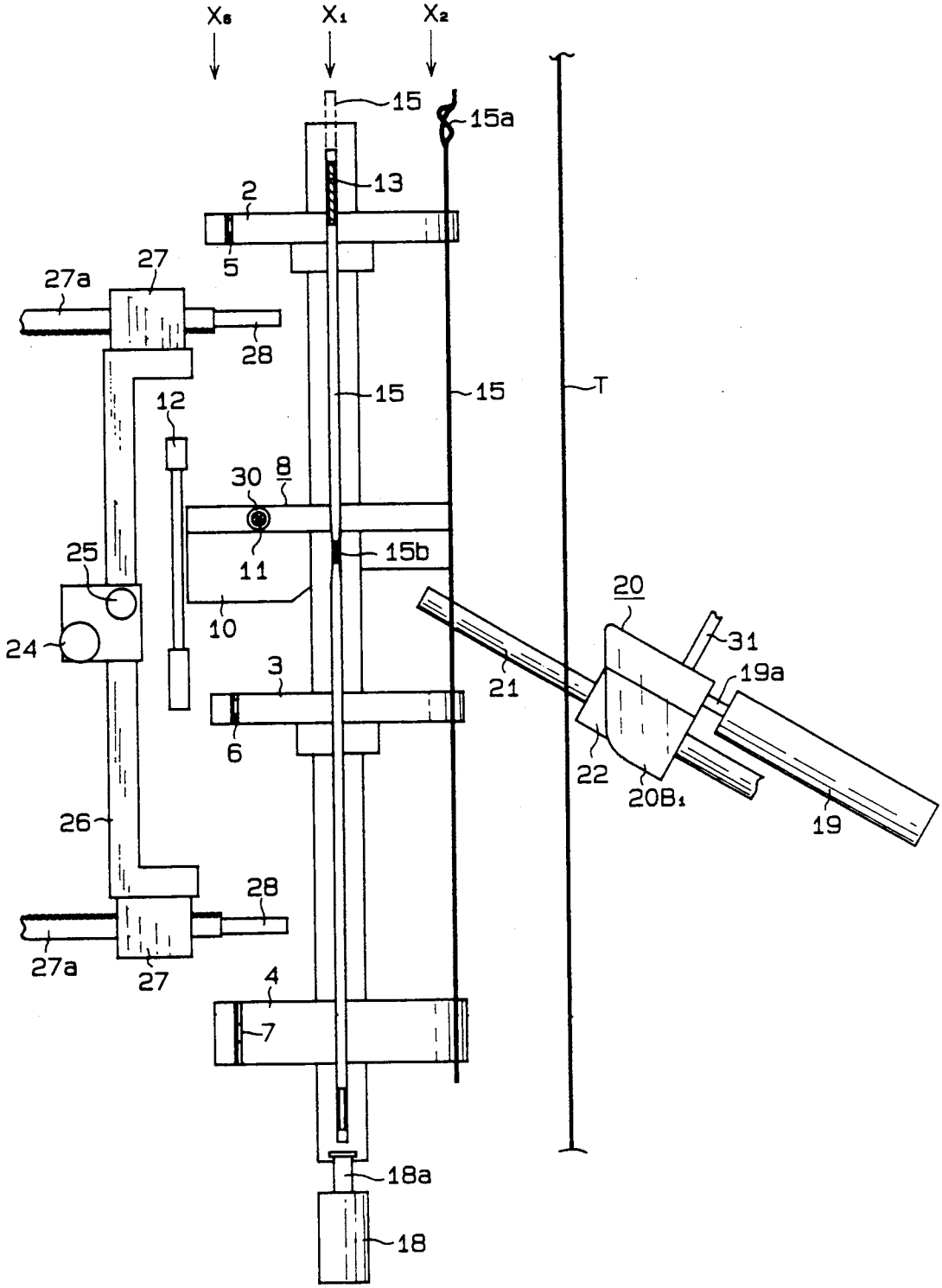
FIG. 3 is a left side view showing the same device.

As shown in FIG. 3, an air cylinder 18 facing upward is provided at a position, corresponding to the position X1, just below the peripheral surface of the supporting disc 4 of lower stage, and a tip of a driving rod 18a can come to contact with an lower end of the heald 15 inserted into the holding concaves 2a, 3a, and 4a which are arranged at the position X1 as the supporting discs 2, 3, and 4 are rotated. The heald 15 in the holding concaves 2a, 3a, and 4a at the position X1 is moved upward with projecting movement of the driving rod 18a , and a torsional portion 15a of an upper end of the heald 15 is detached upward from a torsional portion 15a of a next heald 15. Accordingly, the heald 15 in the holding concaves 2a, 3a, and 4a at the position X1 is carried to a next position X2 which is 60° away from the position X1 when the supporting discs 2, 3, and 4 are rotated, but the next heald 15 is prevented from moving in the direction toward the position X2 by the guiding member 16 and is inserted into next holding concaves 2a, 3a, and 4a rotated from a position X6 and arranged at the position X1.

The holding concaves 2a, 3a, and 4a are successively shifted to be arranged at six 60° divided positions X1, X2, X3, X4, X5, and X6 with 60° intermittent rotations of the driving shaft 1. A position of the entrance 8b of the air guide 8 is preset corresponding to the position X3.

An air cylinder 19 is provided extending slantingly upward at this side of the entrance 8b of the air guide 8, and an air nozzle 20 as air stream generating means and as warp feeding means is fixed at a tip portion of a driving rod 19a thereof. A guiding rail 21 is provided parallel to the driving rod 19a just below a reciprocating route of the air nozzle 20. A slider 22 is supported at the guiding rail 21 and is fixed at a lower surface of the air nozzle 20. Accordingly, the air nozzle 20 is shifted to be arranged at a stand-by position of FIGS. 1 and 2 and at a warp passing through position of FIGS. 4 and 5 without rotating around the driving rod 19a.

Figure 7:
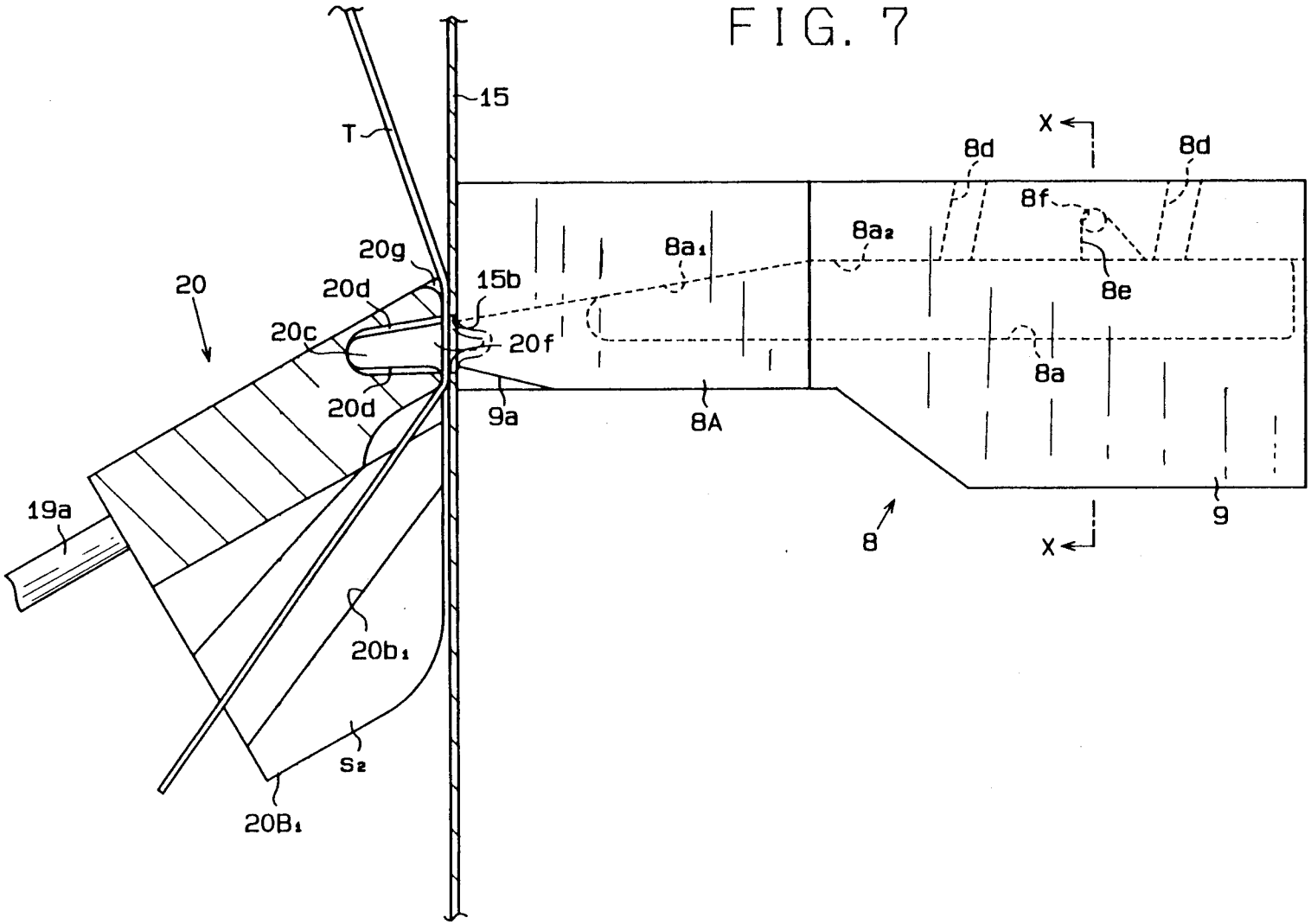
FIG. 7 is a partially broken main portion side view showing the same state.
Figure 8:
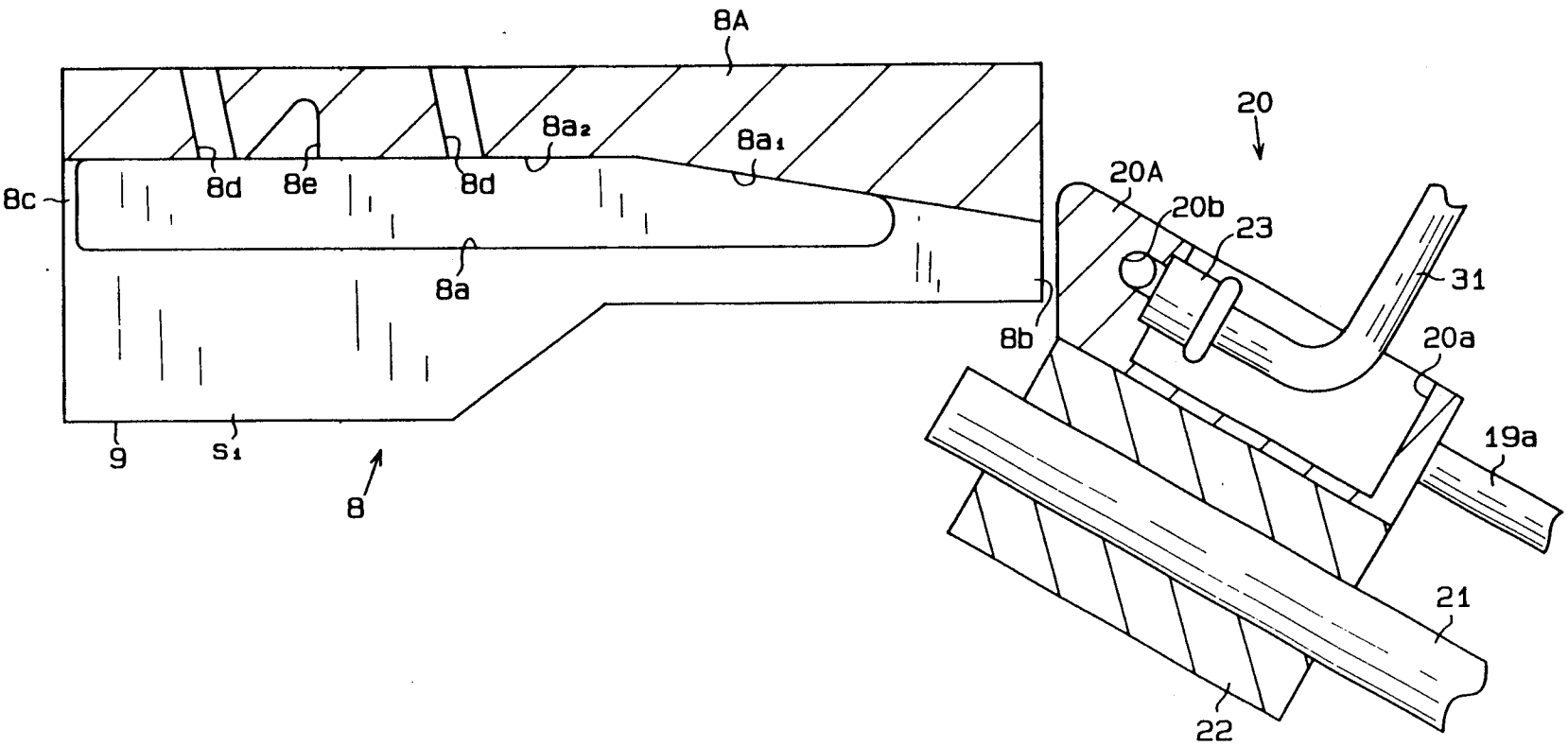
FIG. 8 is a sectional view taken along the VIII—VIII line of FIG. 6.

The air nozzle 20 is formed by joining a pair of nozzle blocks 20A and 20B, and a concave 20a is made on an upper surface of the nozzle block 20A. A pipe coupling 23 is mounted on a front end surface of the concave 20a, an air supplying pipe 31 is connected with the pipe coupling 23, and an air passage 20b communicating with the pipe coupling 23 is passed through the nozzle block 20A. A spouting passage 20c is formed to be a concave on an inner surface of a tip portion of the nozzle block 20B, and the air passage 20b communicates with the spouting passage 20c so that the air passage 20b may substantially cross the spouting passage 20c. As shown in FIGS. 6 and 7, a vertical pair of auxiliary spouting passage 20d are provided at a side surface of the spouting passage 20c, and auxiliary spouting passage 20e of the same kind are also provided at an inner surface of the nozzle block 20A forming the spouting passage 20c.

Figure 9:
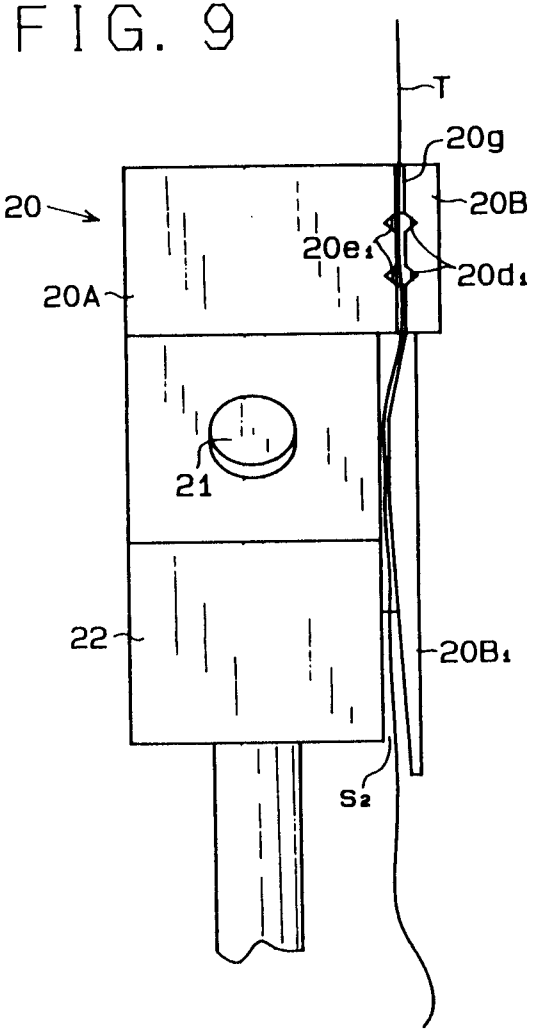
FIG. 9 is a front view showing an air nozzle.

The spouting passage 20c is made to be a going up slant, and a tip of the spouting passage 20c, namely the directivity of a spouting hole 20f, is preset corresponding substantially to the slant rim 8a of the air passage 8a of the air guide 8. The spouting hole 20f is preset to be a slit extending vertically corresponding with a vertical length of a heald hole 15b of the heald 15, the axiliary spouting passages 20d and 20e appear at positions right and left to the spouting hole 20f as spouting concaves 20d1 and 20e1 as shown in FIG. 9.

The nozzle block 20B covers a side surface of the slider 22, and a guiding passage 20b1 shown in FIG. 7 is formed on an inner surface of a covering portion 20B1 thereof. The guiding passage 20b1 is connected with a hooking concave 20g crossing the spouting hole 20f in the vertical direction shown in FIG. 9. A plurality of warps T wound around a warp beam are selected one by one by a not shown reaching machine synchronously with reciprocating motion of the air cylinder 19, and each warp T is arranged just in front of the hooking concave 20g of the air nozzle 20 positioned at the stand-by position of FIGS. 1 and 2. Accordingly, when the air nozzle 20 is moved forward with a projecting motion of the air cylinder 19, a selected warp T is hooked by the hooking concave 20g, and a lower end portion of the warp T is inserted into a slit S2 between the slider 22 and the covering portion 20B1. In this state, the spouting hole 20f comes opposite to the entrance 8b of the air guide 8 via the heald hole 15*b* of the heald 15 at the position X3. Lower ends of a plurality of warps T are detachably gripped by suitable gripping means.

Figure 1:
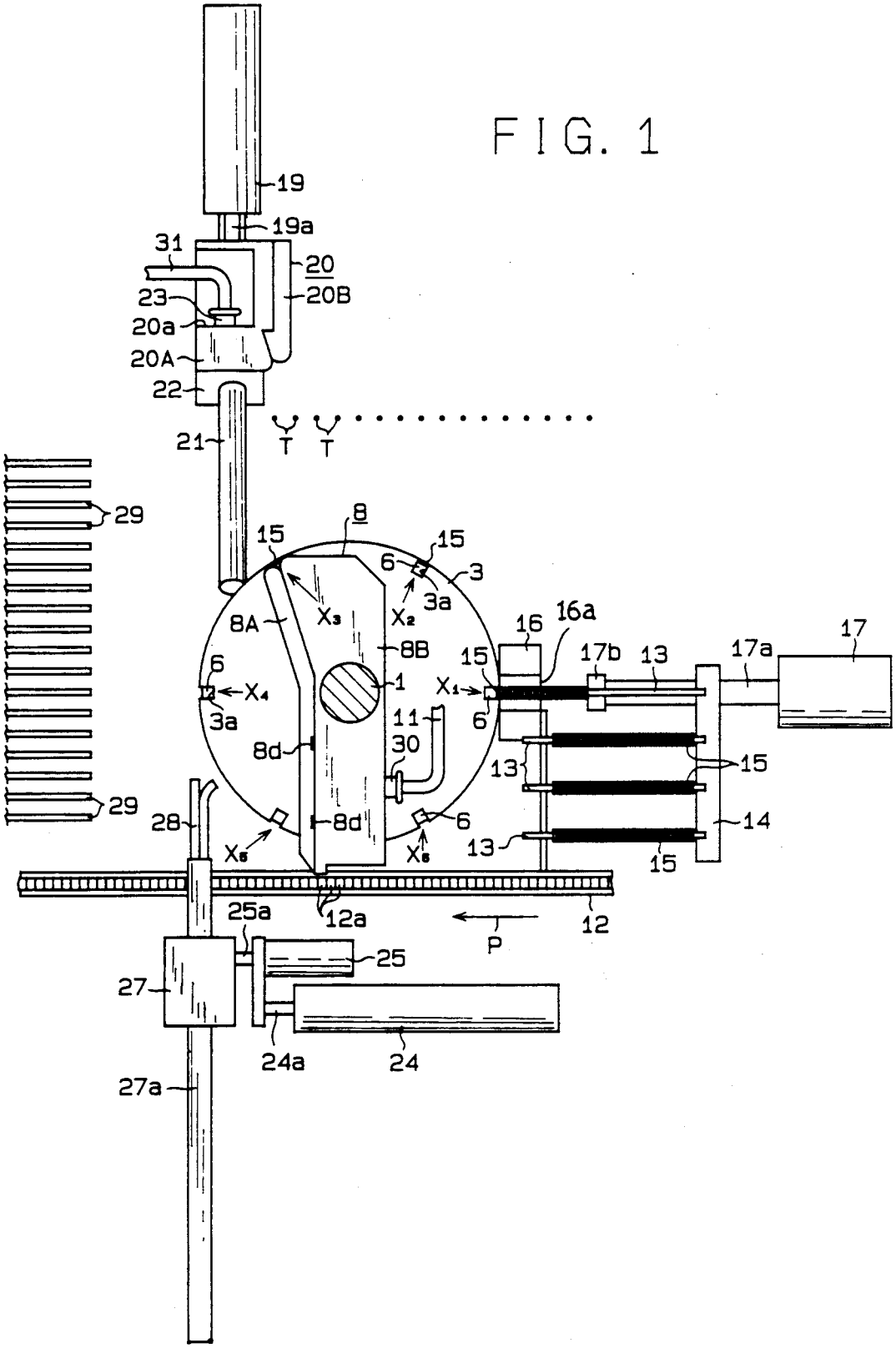
FIG. 1 is a plan view showing a drawing device of a first embodiment.
Figure 2:
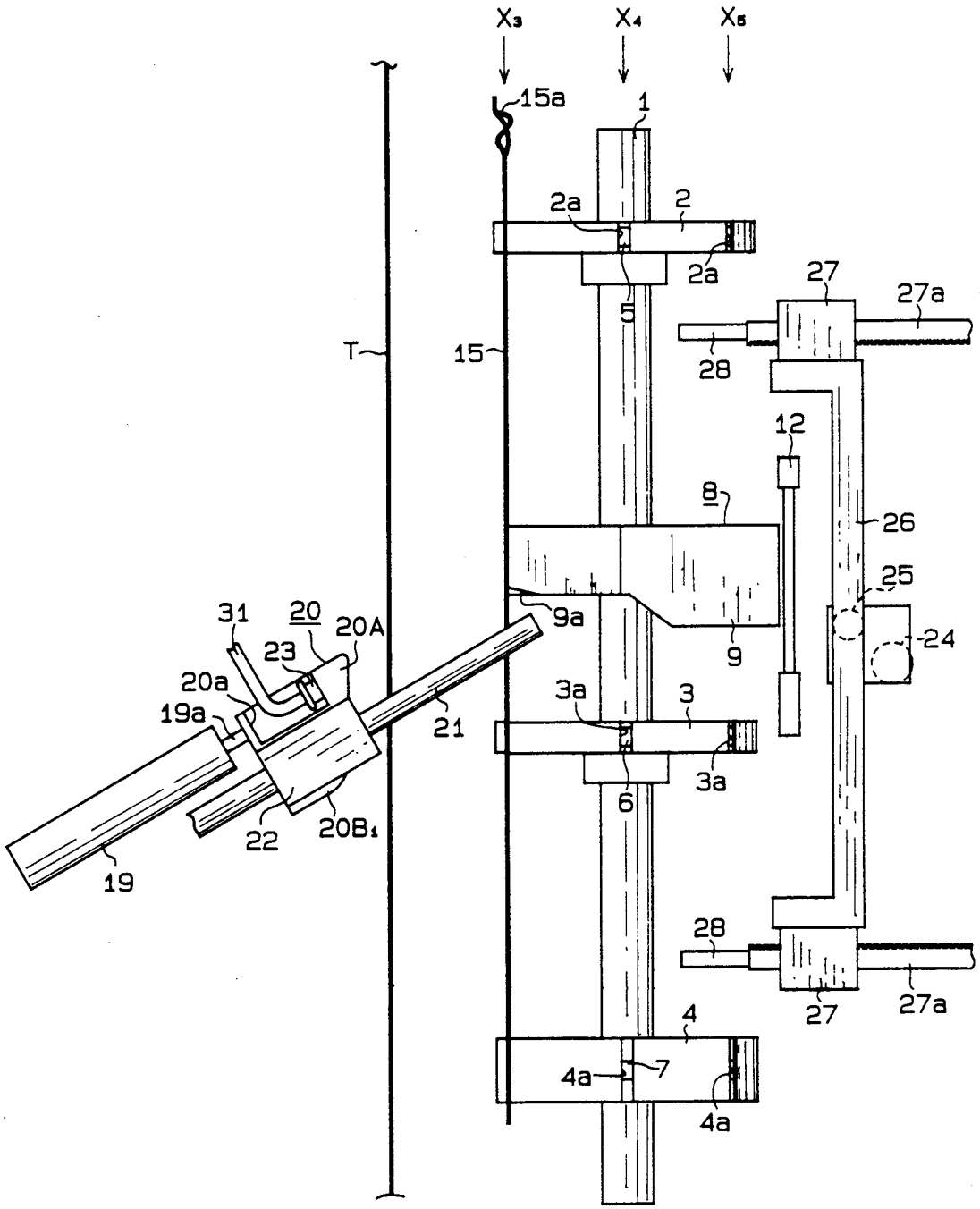
FIG. 2 is a right side view showing the same device.
Figure 4:
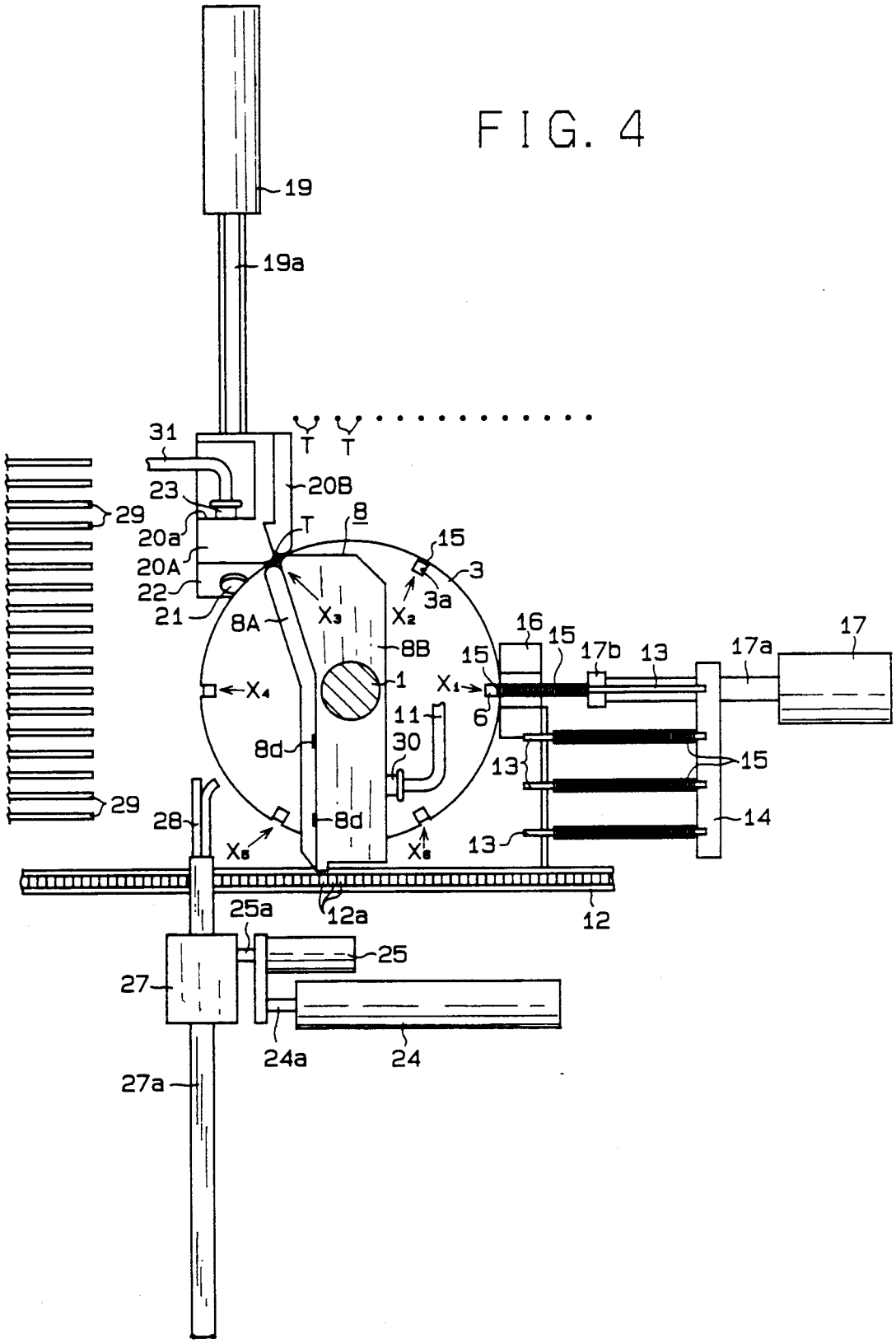
FIG. 4 is a plan view showing a state that an air nozzle is arranged at a warp passing position.
Figure 5:
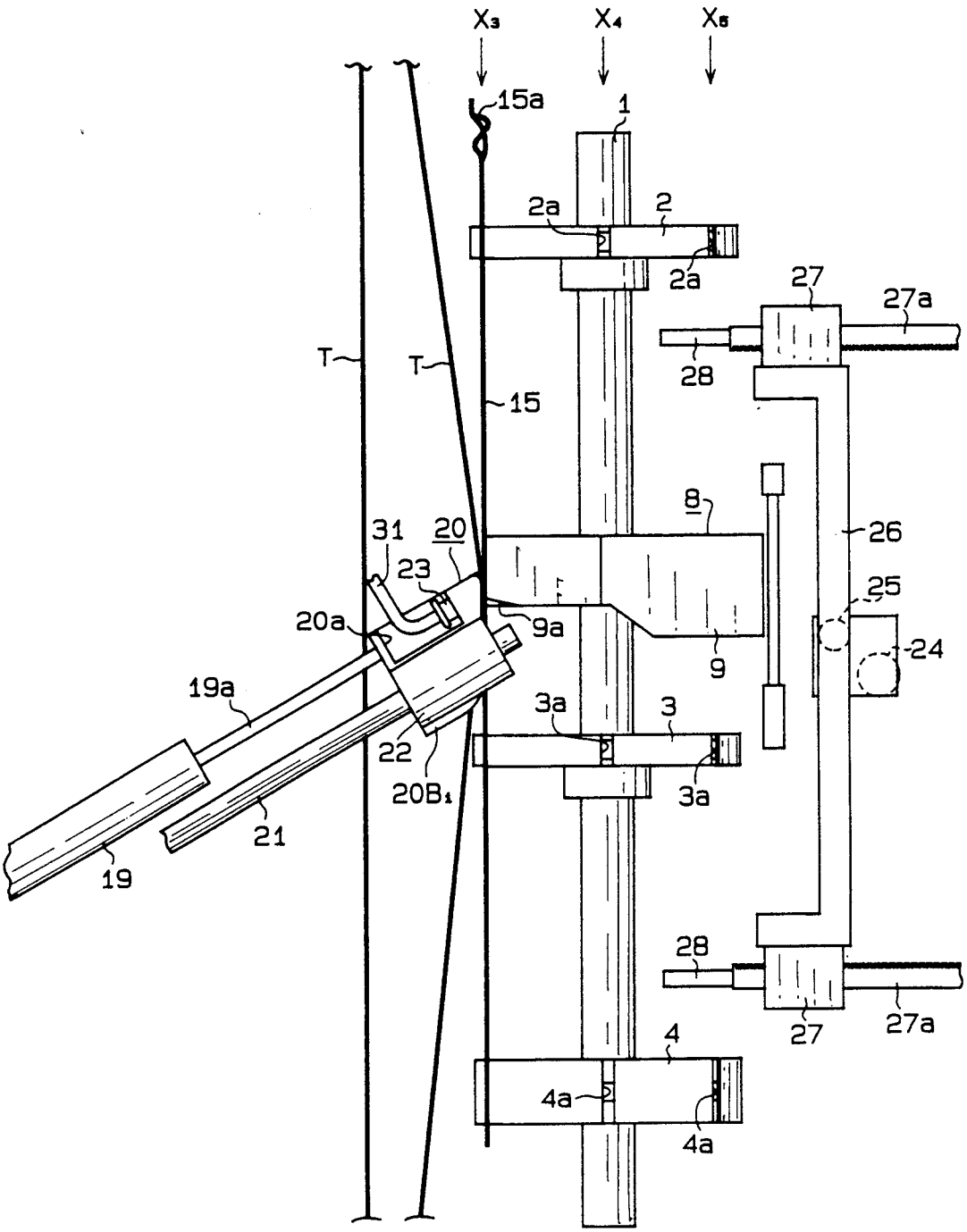
FIG. 5 is a right side view showing the same state.

An air cylinder 24 extending along the moving direction of the reed 12 is provided in front of the driving shaft 1 and the supporting discs 2, 3, and 4 as shown in FIGS. 1 and 4, and an air cylinder 25 extending in the same direction is supported by a driving rod 24*a* thereof. As shown in FIGS. 2 and 5, a supporting member 26 standing upright is attached to a driving rod 25*a* of the air cylinder 25, and motors 27 which can rotate in both directions are fitted in a top and a bottom of the supporting member 26. A rack 27*a* is mounted passing through each motor 27 in the forward and backward direction, namely in the direction crossing the moving direction of the reed 12, and meshes with a driving pinion (not shown) in each motor 27. Accordingly, the racks 27*a* can be reciprocated in the forward and backward direction. Both the motors 27 are driven synchronously, and both the racks 27*a* are integrally moved in the forward and backward direction. A gripper 28 mounted at one end of each rack 27*a* can grip the heald 15 at the position X4 with this forward and backward reciprocating motion.

A plurality of heald rods 29 are provided parallel to each other and arranged in the forward and backward direction at a position left to the driving shaft 1 and the supporting discs 2, 3, and 4, and reciprocating areas of the grippers 28 are preset corresponding with an arranging area of the heald rods 29 in the forward and backward direction. The grippers 28 are usually provided at stand-by positions shown in FIG. 1. Heald keeping means is composed of the air cylinders 24 and 25, the motors 27, the racks 27*a*, the grippers 28, and the heald rods 29. The heald 15 attached by the holding concaves 2*a*, 3*a*, and 4*a* at the position X1 is pushed up to a position of a chain line in FIG. 3 with an operation of the air cylinder 18, and is brought to the position X3 with two intermittent rotations of the driving shaft 1 while attached and held at this pushed up position. When the heald 15 is rotated and brought to the position X3, the air nozzle 20 is moved forward from the stand by position of FIGS. 1 and 2 and comes to be provided at the warp passing through position of FIGS. 4 and 5 while hooking the warp T with an operation of the air cylinder 19. When the air nozzle 20 is positioned at the warp passing through position, a lower end of the warp T is substantially free from gripping operations of said gripping means, and a part, below the spouting hole 20*f*, of the warp T is inserted into the guiding passage 20*b*1 in the slit S2.

After the air nozzle 20 is provided at the warp passing through position, a compressed air is supplied to the air nozzle 20 via the air supplying pipe S1. Accordingly, the compressed air is spouted from the spouting hole 20*f* to the heald hole 15*b* and to the entrance 8*b* of the air guide 8. With this spouting operation, the warp T just in front of the spouting hole 20*f* is inserted into the heald hole 15*b* and into the entrance 8*b* while bent in a state shown as a chain line in FIG. 7.

As the warp T is being inserted into the air guide 8, the part, which is in the slit S2, of the warp T is drawn out of the slit S2 along the guiding passage 20*b*1, and vertical and horizontal vibration of the part, below the spouting hole 20*f*, of the warp T is restricted by the narrow slit S2. The warp T is guided only through the guiding passage 20*b*1, and never goes out of the slit S2. Accordingly, the part, below the spouting hole 20*f*, of the warp T is smoothly guided toward the heald hole 15*b*.

The spouting concaves 20*d*1 and 20*e*1 accurately lead a flying direction of the warp T just in front of the spouting hole 20*f* to the narrow heald hole 15*f* and to the entrance 8*b* of the air guide 8. Namely, without spouting concaves 20*d*1 and 20*e*1, spouting speed in the middle in the right and left direction of the spouting hole 20*f* would come too large compared with those at both sides, and the flying direction of the warp T tends to be led to the right and left sides away from a spouting center. It is thus probable that the warp T can not go into the heald hole 15*b*. With the spouting concaves 20*d* and 20*e*, a difference of the speeds between at the spouting center and at both the right and left sides becomes smaller, and the flying direction of the warp T is made along the spouting center. In other words, an area of straight and parallel spouting becomes wider, so that the warp T may be guided straight into the narrow heald hole 15*b*. Accordingly, the warp T is smoothly inserted into the heald hole 15*b* with a vibration preventing effect of the slit S2 and of the guiding passage 20*b*1 and with a flying direction restricting effect of the spouting concaves 20*d*1 and 20*e*1, and the warp T never fails to be inserted into the heald hole 15*b*.

It can be also sufficiently effective to form a spouting concave only at one side.

Figure 11:
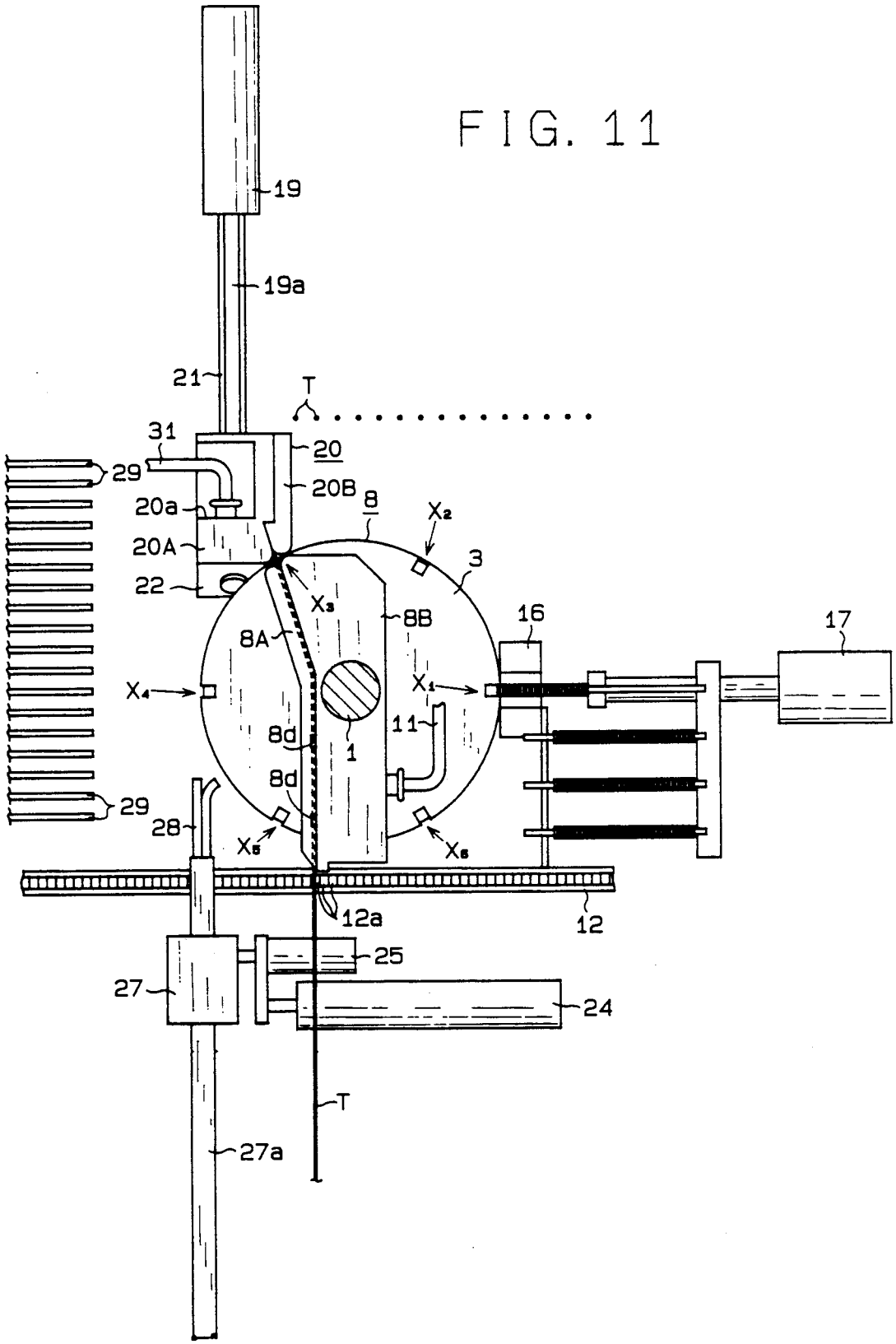
FIG. 11 is a plan view showing a state that a warp is passed through a reed.
Figure 12:
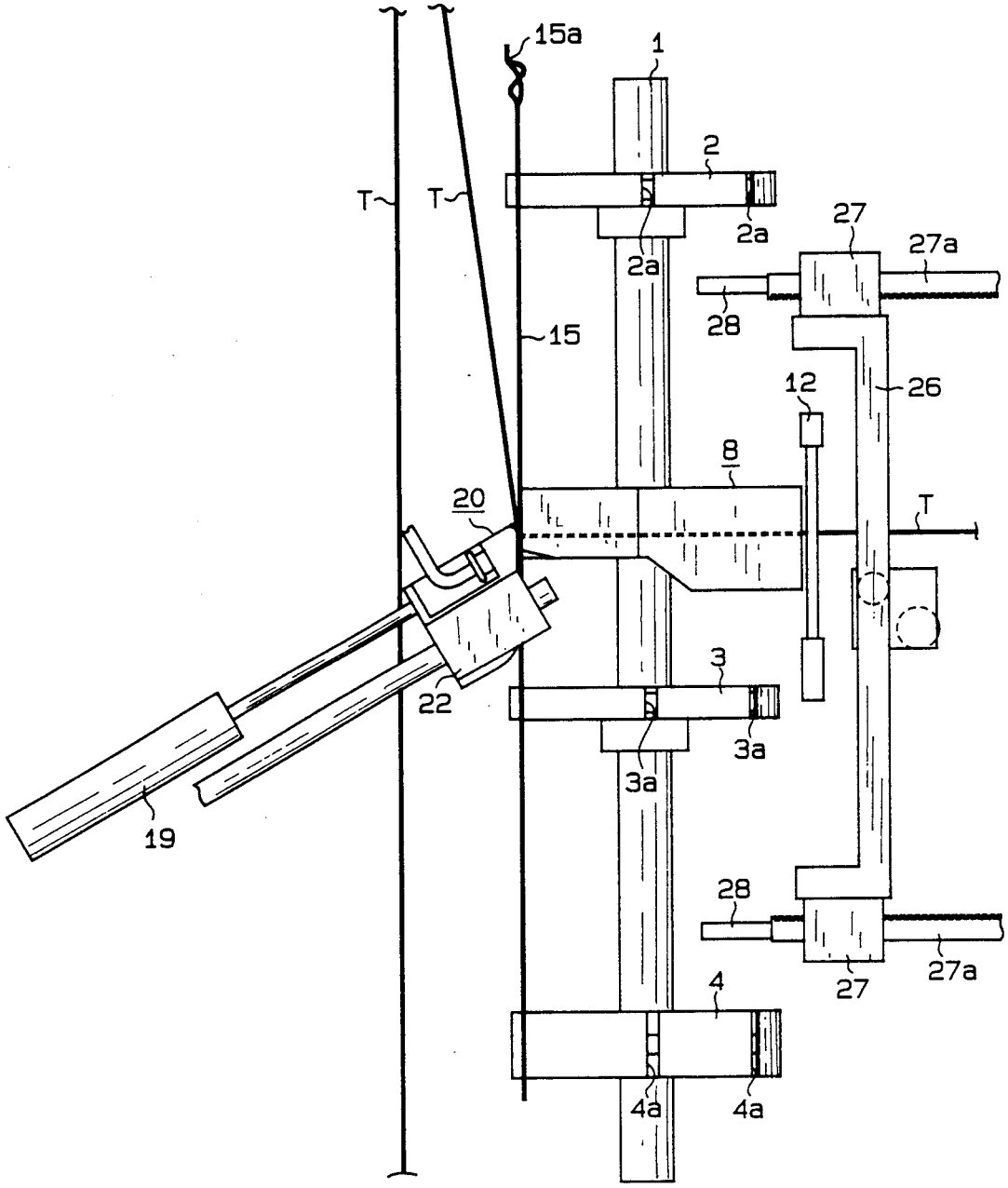
FIG. 12 is a right side view showing the same state.
Figure 13:
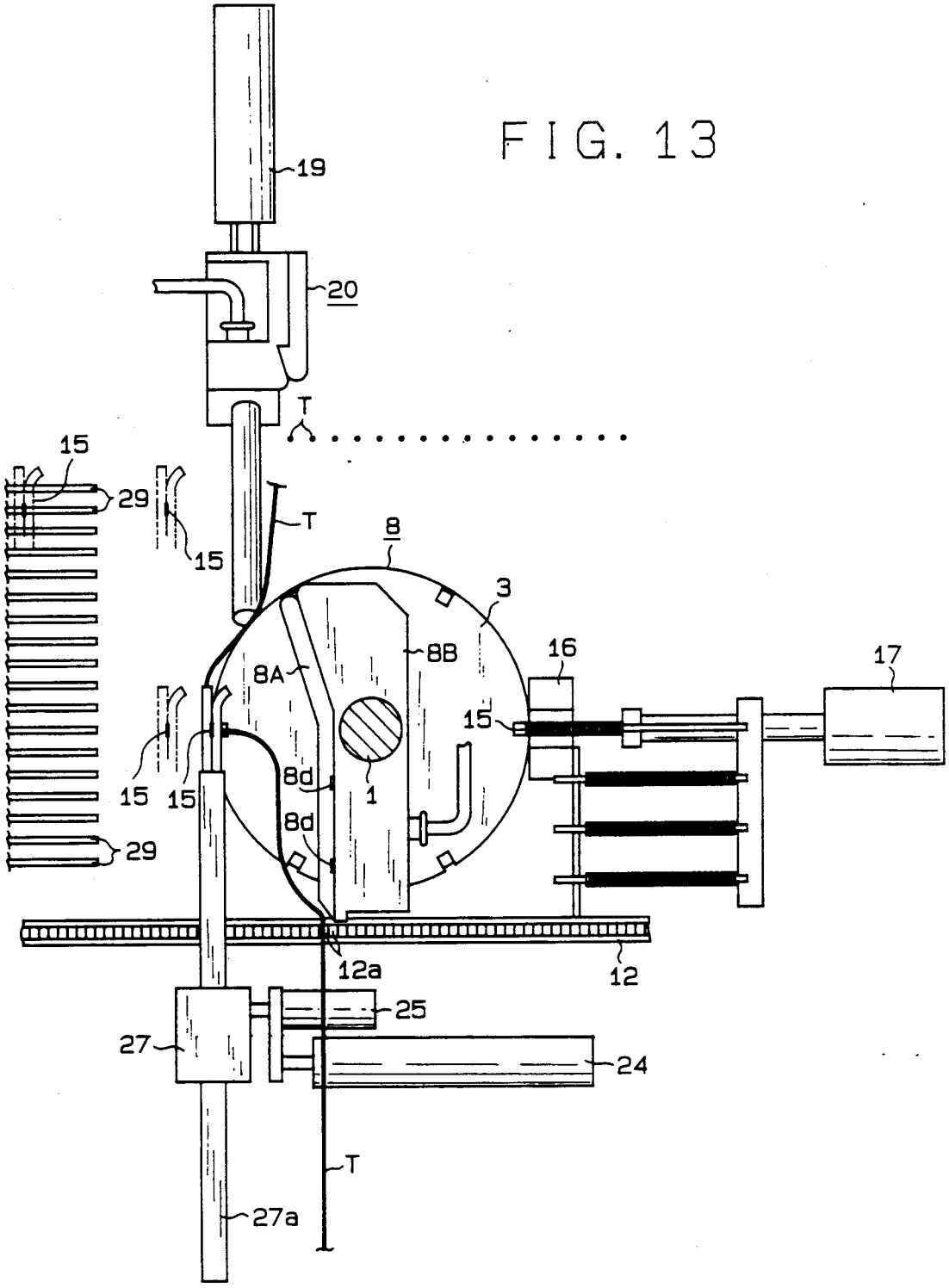
FIG. 13 is a plan view showing a state that a heald through which a warp is passed is held.

The warp T inserted in the air guide 8 is blown out of the exit 8*c* with an air stream, and is passed through the interval 12*a*, facing the exit 8*c*, of the reed 12. The warp T therefore is passed through both the heald 15 and the reed 12 as shown in FIGS. 11 and 12. The warp T is carried with the spouting operation, and this spouting operation is far stronger than a sucking operation. The warp T can be smoothly passed all the way through the reed 12 without any cutoff by presetting a spouting pressure at an appropriate level.

After the warp T is passed through the heald 15 and the reed 12, a compressed air is supplied to the warp discharging spouting hole 8*e* of the air guide 8 via the air supplying pipe 11. Accordingly, the air is spouted downward and toward the exit 8*c* side out of the warp discharging spouting hole 8*e*, and the warp T in the air guide 8 is discharged downward out of the warp discharging slit S1. There is a certain amount of frictional resistance between a part of the warp T and the reed 12 at the interval 12*a* between the reed dents depending upon kinds of the warps T, and this resistance prevents the warp T in the air guide 8 from falling off downward. A warp discharging effect against and greater than said frictional resistance can be achieved by presetting the spouting direction of the warp discharging spouting hole 8*e* as described above. The warp T in the air guide 8 is thus smoothly discharged out of the warp discharging slit S1.

The air spouted into the air guide 8 from the air nozzle 20 goes along the air passage 8*a* , but part of the air could be gone out of the warp discharging slit S1 in the rear half side because of diffusion effect of the spouting air. However, the downward diffusion of the spouting air at the rear half can be minimized because the upper rim of the air passage 8*a* at the front half side is formed to be the going up slant rim 8*a*1. The spouting direction of the spouting hole 20*f* of the air nozzle 20 is made to be substantially along the slant rim 8*a*1, so that the spouting air from the air nozzle may go slightly upward along the slant rim 8*a*1 in the front half side in the air guide 8. Accordingly, the downward diffusion of the air stream at the horizontal rim 8a2 in the rear half side in the air passage 8a can be more effectively minimized, and the warp T flying through the air guide 8 is prevented from going out of the warp discharging slit S1. The slit forming walls 9 and 10 extending downward in the rear half side can more effectively prevent the warp T from hopping out of the warp discharging slit S1 in the rear half side.

Moreover, the air releasing holes 8d formed at the horizontal rim 8a2 will attract the central stream of the air stream in the air passage 8a upward. Accordingly, the warp T flying through the air guide 8 is attracted upward staying away from the warp discharging slit S1, and this attracting operation more effectively prevents the warp T from going out the warp discharging slit S1.

As for the air passage 8a of the air guide 8 and the warp discharging slit S1 which effectively prevents the warp T from going out of the air guide 8, the front half side thereof is bent and slants leftward to the rear half side as shown in FIG. 6. This bent shape is preset corresponding to the direction of the heald hole 15b of the heald 15 at the warp passing through position X3. The directivity of the spouting hole 20f of the air nozzle 20 is also preset corresponding to the slanting direction of the air passage 8a in the front half side. Accordingly, a passing section area of the heald hole 15b to the spouting air from the air nozzle 20 can be maximized, and in addition, introduction of the air into the entrance 8b of the air guide 8 can be performed at a maximum efficiency. A smooth insertion of the warp T into the heald hole 15b and the entrance 8b can be improved because of the preset shape and direction as described above.

Figure 10:
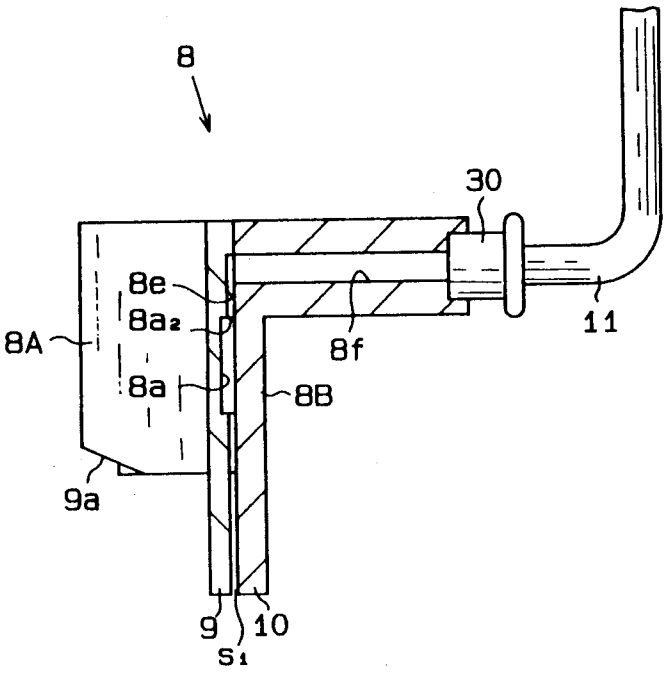
FIG. 10 is a sectional view taken along the X—X line of FIG. 7.

The bent shape of the warp discharging slit S1 contributing to the smooth insertion of the warp T may in turn be a certain obstacle to discharge the warp T out of the air guide 8. Namely, the warp T in the air guide 8 has to be pushed downward to be discharged. In this case, the warp T is likely to be hooked by a corner even when this lower side corner at the entrance 8b side of the slit forming walls 9 is made to be a right angle. Accordingly, a cutoff slant portion 9a is formed at the lower side corner at the entrance 8b side of the slit forming wall 9 as shown in FIGS. 7 and 10, so that the warp T may be prevented from being hooked when discharged.

Figure 14:
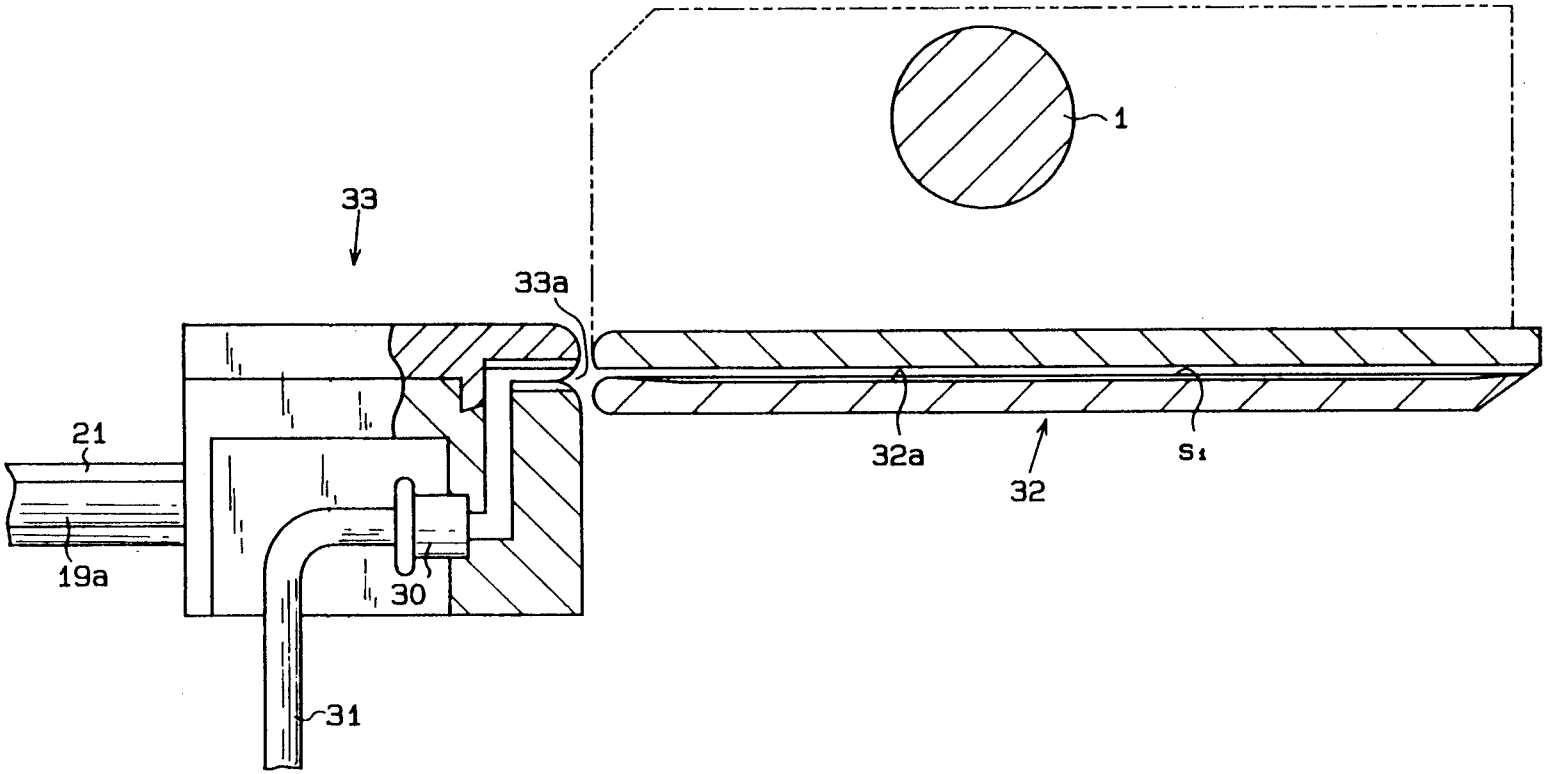
FIG. 14 is a main portion sectional plan view showing another embodiment.

After the warp T is passed through the heald 15 and the reed 12, the air nozzle 20 comes back to the stand-by position with a pulling-in motion of the air cylinder 19. and the driving shaft 1 is rotated in 60° to move the heald 15 at the warp passing through position X3 to the insertion stand-by position X4 as shown in FIG. 14. The grippers 28 are then moved to positions where the grippers 28 can grip the heald 15 at the insertion stand-by position X4 with a synchronous regular rotation of both the motor 27, and the heald 15 is gripped by the grippers 28. The heald 15 is detached from the holding concaves 2a, 3a, and 4a at the insertion stand-by position X4 toward the heald rods 29 side with a projecting motion of the air cylinder 25, and the heald 15 is fitted on a selected heald rod 29 with a start of the motors 27 and with a projecting motion of the air cylinder 24. And then, the grippers 28 come back to the stand-by positions shown in FIG. 1 with starts of the air cylinders 24 and 25 and of the motors 27.

This invention is not limited to the above embodiment. For example, an air passage 32a of an air guide 32 can be formed straight, and the directivity of a spouting hole 33a of an air nozzle 33 can be made corresponding to that of the air passage 32a as shown in FIG. 14. Also possible is an embodiment that the slant rim 8a1 extends further straight instead of using the horizontal rim 8a2 of the air passage 8a of the air guide 8 in said embodiment. Moreover, an air nozzle can be fixed at the warp passing through position, and a warp T can be selected to be provided just in front of a spouting hole of this air nozzle.

[A second embodiment]

A drawing device of a second embodiment of the present invention is now described referring to FIGS. 15 to 18 while comparing differences between the first and second embodiments. Those elements which correspond to those of the first embodiment employ the same reference numerals in the second embodiment as those in the first embodiment, and explanation of those elements is omitted.

Figure 15:
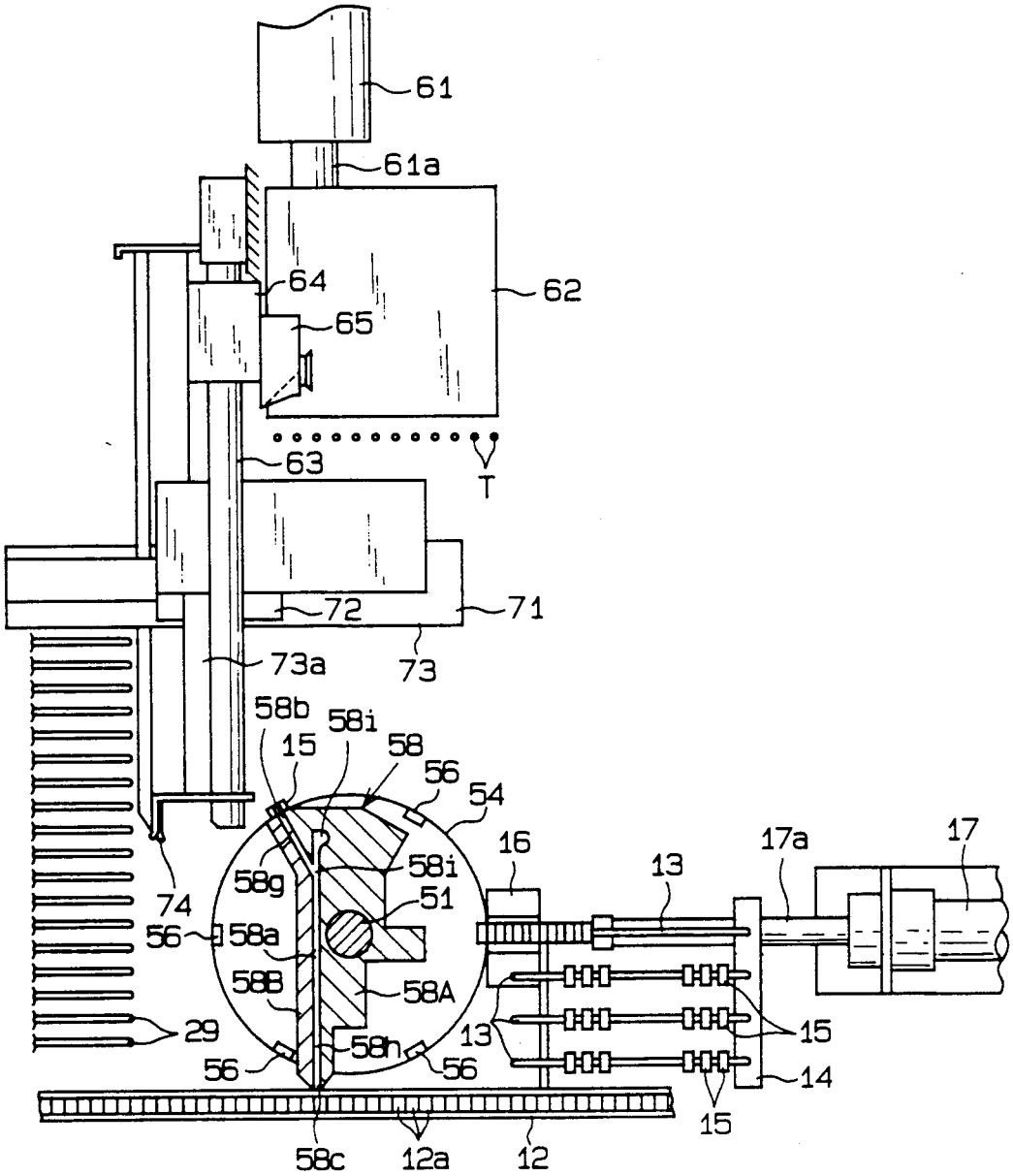
FIG. 15 is a plan view showing a drawing device of a second embodiment.
Figure 17:
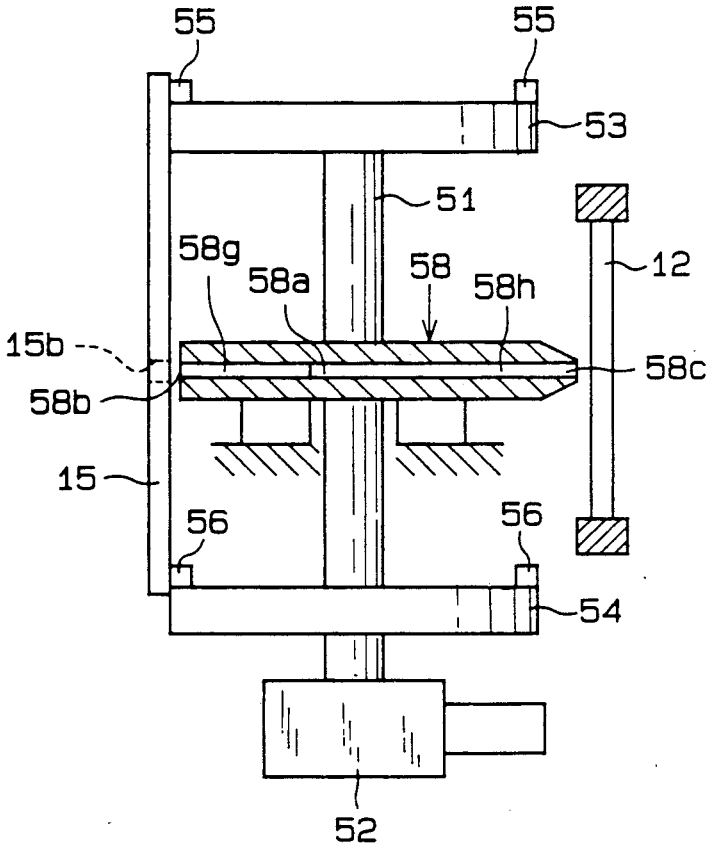
FIG. 17 is a sectional view showing an air guide.
Figure 18:
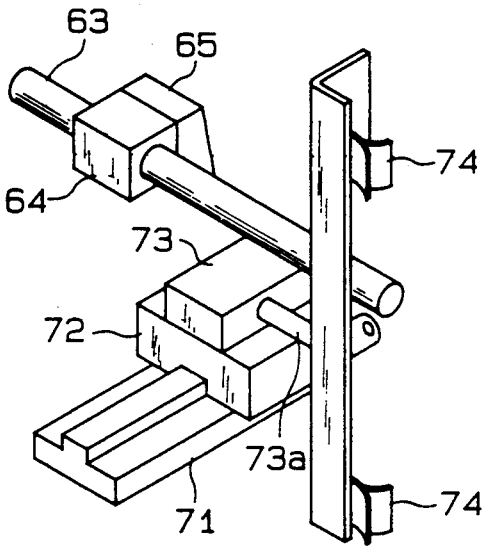
FIG. 18 is a perspective view showing a relationship of positions of a warp feeding device and of a heald delivering device.

As shown in FIGS. 15 and 17, a driving shaft 51 is connected with an intermittent driving mechanism 52. A pair of supporting discs 53 and 54 as heald moving means are vertically fixed to the driving shaft 51 in parallel in an interval corresponding to length of the heald 15. The supporting discs 53 and 54 are intermittently driven via the driving shaft 51 and rotated in 60° each time with a driving of the intermittent driving mechanism 52. The holding concaves are not provided on the supporting discs 53 and 54, and instead six permanent magnets 55 and 56 as the heald holding means are provided on an outer rim of an upper surface of each supporting disc 53 and 54 in an interval of 60° in its peripheral direction. A pair of permanent magnets 55 and 56 vertically corresponding to each other cooperate with each other to hold the heald 15 with magnetic force.

An air guide 58 is fixed between both the supporting discs 53 and 54. The air guide 58 is composed of a first guiding segment 58A and a second guiding segment 58B openably attached to the first guiding segment 58A. An air passage 58a is formed passing through the air guide 58, but the warp discharging slit is not formed and the lower end of the air guide 58 is closed. A warp T in the air passage 58a can be taken out of the air guide 58 by opening the second guiding segment 58B while the warp T is passed through the heald 15 and between the reed dents 12a. The air passage 58a is divided at a bent portion 58i into an entrance side passage 58g positioned at an entrance 58b side and an exit side passage 58h positioned at an exit 58c side. One end of an air introducing hole 58j which has substantially the same directivity as that of the exit side passage 58h communicates with the air passage 58a at the bent portion 58i, and a not shown air supplying source is connected with the other end of the air introducing hole 58j to make it possible to supply the compressed air from the air supplying source to the exit side passage 58h of the air passage 58a via the air introducing hole 58j. When the compressed air is supplied from the air introducing hole 58j to the exit side passage 58h of the air passage 58a, negative pressure is generated at the entrance side passage 58g by an air stream running through the exit side passage 58h toward the exit 58c, and an air stream running through the entrance side passage 58g from the entrance 58b toward the bent portion 58i is generated with an ejector effect of the negative pressure. Then a warp T arranged at the entrance 58b is sucked into the entrance side passage 58g by the air stream and is passed through the heald hole 15*b* of the heald 15 and through the reed dents 12*a*.

After the warp T is passed through the heald 15 and the reed dents 12*a*, the second guiding segment 58B is opened by not shown open and close control means, and the warp T in the air guide 58 is taken out of the air passage 58*a* while drawn by the heald 15 with a motion of the heald 15 accompanied with a rotation, from the position X3 to the position X4, of the supporting discs 53 and 54. The second guiding segment 58B is then closed by the open and close control means.

The air guide 58 of the present embodiment has not only a function of guiding means for guiding the warp T but also a function of air stream generating means for generating an air stream which carries the warp T. In the present embodiment, a sucking effect generated in the air passage 58*a* of the air guide 58 is made use to carry the warp T. A warp carrying force of the present embodiment is a little inferior to that of the spouting effect by the air nozzle 20 into the air passage 8*a*, but it is of course possible to insert and carry smoothly the warp T from the heald hole 15*b* of the heald 15 to an interval between the reed dents 12*a* by this sucking effect.

Figure 16:
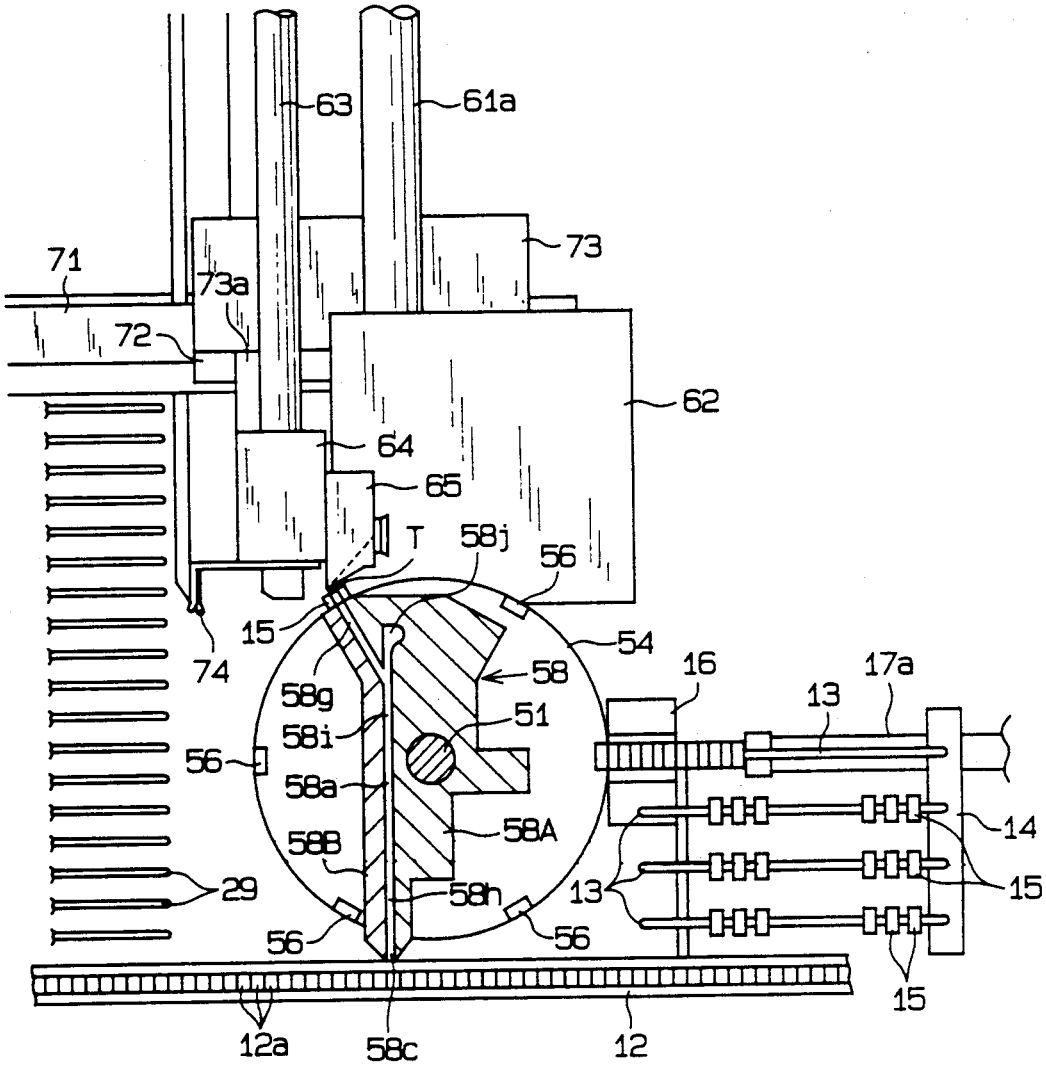
FIG. 16 is a partially enlarged plan view showing the same device.

As shown in FIGS. 15 and 16, a reaching machine 62 is disposed adjacent to a cylinder 61 extending forward and backward. The reaching machine 62 is operationally connected with a slider 64 slidably fitted to a guiding rail 63 fixed to extend in the same direction of the length of the cylinder 61, and the reaching machine 62 and the slider 64 can operate interlockingly. To the slider 64 is fixed a warp feeding member 65 as warp feeding means to feed the warp T singly selected by the reaching machine 62 to the position X3. The warp feeding member 65 has the same structure as the warp hooking concave 20*g* of the air nozzle 20 of the first embodiment. However, being different from the air nozzle 20 of the first embodiment, structures for spouting an air stream into the air guide 58 namely the spouting hole, the spouting concaves, and so on are not provided at the warp feeding member 65 because the air stream generating means is provided at the air guide 58 itself. The slider 64 is reciprocated along the guiding rail 63 driven by the cylinder 61. The warp feeding member 65 hooks and feeds the warp T to the position X3 with an approach of the glider 64 to the air guide 58 as a result of projection of a driving rod 61*a* of the cylinder 61.

Behind the supporting discs 53 and 54 is arranged heald keeping means for carrying the heald 15, through which the warp T is passed, to the heald rods 29 and for keeping the heald 15 at the heald rods 29. A slider 72 is slidably supported by the guide rail 71 extending in the direction substantially crossing the guiding rail 63 of the warp feeding means. A gripper 74 is fixed to a rod 73*a* of a moving member 73 fitted in the slider 72. The rod 73*a* is reciprocated by means of the moving member 73. The gripper 74 grips the heald 15 at the position X4 with projection of the rod 73*a*. The slider 72 then slides along the guiding rail 71 toward the heald rods 29 by means of not shown driving means, and the heald 15 is fitted to and kept at the selected single heald rod 29 as in the first embodiment.

In the present invention, for example, a sucking structure as the heald holding means instead of the magnets can be adopted to suck and hold the heald, and the number of the heald holding means can be increased or decreased, and the intermittent rotation angle of the supporting discs by the intermittent driving mechanism can be changed corresponding to these numbers.

As many apparently widely different embodiments of this invention may be made without departing from the spirit and scope thereof, it is to be understood that the invention is not limited to the specific embodiments thereof except as defined in the appended claims.

What is claimed is:

1. A drawing device comprising:

an air guide including an air passage having an entrance and an exit;

air stream generating means operationally connected with said air passage for generating an air stream running from said entrance toward said exit in said air passage;

oppositely arranging means adjacent to said air guide for arranging said entrance opposite to a heald hole of a heald and for arranging said exit opposite to an interval between reed dents of a reed.

2. A drawing device according to claim 1 wherein said air stream generating means is provided at said air guide, and comprises an air introducing hole extending in the direction from a part, between said entrance and said exit, of said air passage to another part, positioned at said entrance side to said part, of said air guide, said air introducing hole communicating with said air passage and spouting a compressed air toward said exit.

3. A drawing device according to claim 1 wherein said air stream generating means is provided adjacent to said air guide, and comprises an air nozzle spouting a compressed air into said entrance in the direction toward said entrance of said air passage at least when a warp is being passed through the heald hole of the heald.

4. A drawing device according to claim 3 wherein said air guide further includes a warp discharging slit extending along a whole length of said air passage to have said air passage communicate with an outside of said air guide.

5. A drawing device according to claim 4 wherein an inner surface, opposite to said warp discharging slit, of said air passage is composed of a first rim extending along a length of said air passage at said exit side and a second rim connected with said first rim at said entrance side, said second rim slanting in a direction away from said warp discharging slit as said second rim comes closer to said first rim.

6. A drawing device according to claim 5 wherein a spouting direction of the compressed air into said air guide by said air nozzle substantially corresponds to a slanting direction of said second rim.

7. A drawing device according to claim 4 wherein said warp discharging slit extends in a direction away from said air passage at said exit side rather than at said entrance side.

8. A drawing device according to claim 4 wherein said air guide further includes a warp discharging spouting hole provided at a side, opposite to said warp discharging slit, of said air passage, and communicating with said air passage so as to have directivity toward said exit side and to be able to spout the compressed air toward said warp discharging slit at said exit side.

9. A drawing device according to claim 4 wherein said air guide further includes an air releasing hole provided at a side, opposite to said warp discharging slit, of said air passage, and communicating with said air passage so as to have directivity toward said entrance side.

10. A drawing device according to claim 4 wherein said air passage and said warp discharging slit of said air guide comprises a first portion extending in a longitudinal direction of said air passage at said exit side, and a second portion extending slantingly to said first portion, in a direction away from a plan including said first portion, from an end portion of said first portion at said entrance side to said entrance, and said air guide further includes a cutoff slant portion having said warp discharging slit communicate with an outside of said air guide at said slanting direction side of said entrance portion of said air passage.

11. A drawing device according to claim 4 wherein said air nozzle has a spouting hole having a length extending from said air passage to said warp discharging slit and for spouting the compressed air to the entrance of said air guide, and spouting concaves provided at one side in a direction crossing a length of said spouting hole and extending in said crossing direction for spouting the compressed air to said entrance of said air guide at said one side.

12. A drawing device according to claim 11 wherein said air nozzle can come close to and come apart from said air guide, and has a warp hooking concave extending along the length of said spouting hole and hooking a warp positioned in front of said spouting hole when approaching said air guide and a warp guiding slit provided in series of said hooking concave at one side in a longitudinal direction of said spouting hole for guiding said warp.

13. A drawing device according to claim 1 wherein said oppositely arranging means includes heald feeding and moving means for feeding one heald just in front of said entrance of said air passage and for arranging the heald so that a heald hole of the heald may be opposite to said entrance.

14. A drawing device according to claim 13 wherein said heald feeding and moving means has heald moving means for moving the heald from a first position apart from said entrance of said air guide to the second position just in front of said entrance and heald feeding means for feeding the heald to said first position one by one.

15. A drawing device according to claim 14 wherein said heald moving means comprises supporting discs, which can rotate from said first position to said second position, having heald holding means for holding the heald but not the heald hole.

16. A drawing device according to claim 14 further comprising heald keeping means for keeping the heald, through which the warp is passed, at said first position apart from said air guide wherein said heald moving means moves the heald to a third position opposite to said first position via said second position, and said heald keeping means keeps the heald at a keeping position after moving the heald at said third position to said keeping position.

* * * * *